US008532507B2

(12) United States Patent
Abe

(10) Patent No.: US 8,532,507 B2
(45) **Date of Patent: *Sep. 10, 2013**

(54) IMAGE FORMING APPARATUS IN WHICH GENUINE CARTRIDGE WITH AND WITHOUT MEMORY DEVICE ARE USABLE

(75) Inventor: Naoki Abe, Nagoya (JP)

(73) Assignee: Brother Kogyo Kabushiki Kaisha, Nagoya-shi (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/411,834

(22) Filed: Mar. 5, 2012

(65) Prior Publication Data

US 2012/0163836 A1 Jun. 28, 2012

Related U.S. Application Data

(63) Continuation of application No. 11/935,778, filed on Nov. 6, 2007, now Pat. No. 8,145,075.

(30) Foreign Application Priority Data

Nov. 16, 2006 (JP) ..... 2006-310282

(51) Int. Cl.
*G03G 15/00* (2006.01)

(52) U.S. Cl.
USPC ..... 399/12

(58) Field of Classification Search
USPC ..... 399/12, 13, 111, 119, 120, 258, 262; 33/12, 13, 111, 119, 120, 258, 262
See application file for complete search history.

(56) References Cited

U.S. PATENT DOCUMENTS

| | | | |
|---|---|---|---|
| 2002/0131784 | A1 | 9/2002 | Takemoto |
| 2002/0143893 | A1 | 10/2002 | Nakazono et al. |
| 2003/0209464 | A1* | 11/2003 | Otsuka et al. |
| 2004/0161251 | A1 | 8/2004 | Ito et al. |
| 2006/0051106 | A1 | 3/2006 | Takahashi et al. |
| 2007/0201883 | A1 | 8/2007 | Nakazawa et al. |
| 2007/0297815 | A1 | 12/2007 | Takada |

FOREIGN PATENT DOCUMENTS

| | | | |
|---|---|---|---|
| JP | 09-327957 | A | 12/1997 |
| JP | 2002-278249 | A | 9/2002 |
| JP | 2006-215441 | A | 8/2006 |

* cited by examiner

*Primary Examiner* — Walter L Lindsay, Jr.
*Assistant Examiner* — Milton Gonzalez
(74) *Attorney, Agent, or Firm* — Banner & Witcoff, Ltd.

(57) ABSTRACT

An image-forming apparatus includes a main body and a genuine toner cartridge without a memory device that is supplied with the main body. The apparatus includes a cartridge installation part configured to receive at least two different types of toner cartridges, including the genuine cartridge without a memory device and a genuine toner cartridge with a memory device that is to be supplied as a replacement for the genuine toner cartridge without a memory device. Also, the apparatus includes a reader configured to retrieve data from the memory device of the genuine toner cartridge with the memory device received in the cartridge installation part.

6 Claims, 9 Drawing Sheets

IMAGE FORMING APPARATUS IN WHICH GENUINE CARTRIDGE WITH AND WITHOUT MEMORY DEVICE ARE USABLE

CROSS-REFERENCE TO RELATED APPLICATION(S)

This application is a continuation of prior U.S. application Ser. No. 11/935,778, filed Nov. 6, 2007, which claims the foreign priority benefit under Title 35, United States Code, §119 (a)-(d), of Japanese Patent Application No. 2006-310282, filed on Nov. 16, 2006 in the Japan Patent Office, the disclosure of which is herein incorporated by reference in its entirety.

BACKGROUND OF THE INVENTION

1. Field of the Invention

The present invention relates to an image-forming apparatus, such as a laser printer and a digital copier, having a toner cartridge.

2. Description of Related Art

Typically, in a laser printer or a digital copier, as an example of the image-forming apparatus, a toner cartridge or other consumable part is installed removably and configured replaceably. In order to verify whether or not a toner cartridge installed for replacement is a genuine toner cartridge (hereinafter referred to also as "genuine product"), various image-forming apparatuses have been proposed.

In an image-forming apparatus disclosed in JP 2006-215441 A (claim 1 and FIG. 2), a memory device having an identification code stored therein is installed in the toner cartridge, so that the identification code stored in the memory device is retrieved to verify whether or not the toner cartridge is a genuine product.

Hereupon, the toner cartridge packaged and supplied together with the image-forming apparatus at the time of purchase of the apparatus (hereinafter referred to as "supplied toner cartridge") is, needless to say, a genuine product, and thus theoretically need not have any memory device, such as a radio frequency identification (RFID), installed therein. However, a hitherto known apparatus always used to have a memory device installed in its supplied toner cartridge as well by necessity, because the verification would produce an erroneous result that the supplied toner cartridge is not a genuine product if it had no memory device installed therein. This would disadvantageously entail unnecessary cost.

It would thus be desirable to provide an image-forming apparatus which properly distinguishes between the genuine toner cartridge and the other toner cartridge (hereinafter referred to also as "non-genuine product") to exercise control tailored to these two types of toner cartridge, even if the installed toner cartridge is a supplied toner cartridge without any memory device included therein. Against this backdrop, the present invention has been made in an attempt to overcome the disadvantages described above.

Illustrative, non-limiting embodiments of the present invention overcome the above disadvantages and other disadvantages not described above. Also, the present invention is not required to overcome the disadvantages described above, and an illustrative, non-limiting embodiment of the present invention may not overcome any of the problems described above.

SUMMARY OF THE INVENTION

In one aspect of the present invention, there is provided an image-forming apparatus having a function of verifying genuineness of a toner cartridge with or without a memory device to form an image using toner contained in the toner cartridge. The image-forming apparatus according to an exemplary embodiment of the present invention comprises a counter, a cartridge detector, a reader and a controller. The counter is configured to count a value concerning image formation each time when the image-forming apparatus performs the image formation. The cartridge detector is configured to determine the presence or absence of the toner cartridge. The reader is configured to retrieve data from a memory device in the toner cartridge. The controller is configured to exercise one of two types of control over units of the image-forming apparatus. The type of control the controller is configured to exercise is either a first type of control conformable to a toner cartridge other than a genuine toner cartridge or a second type of control conformable to the genuine toner cartridge. The first type of control is exercised if the following conditions are satisfied: the cartridge detector determines that the toner cartridge is present; the value counted by the counter is greater than a predetermined value; and the reader has failed retrieval of predetermined data. Otherwise (if any of the above conditions is not satisfied), the second type of control conformable to the genuine toner cartridge is exercised.

With this configuration, the controller is configured to exercise the second type of control conformable to the genuine toner cartridge when the value counted by the counter is not greater than a predetermined value even if the reader has failed retrieval of predetermined data for reasons, such as the absence of the toner cartridge or the absence of the memory device in the toner cartridge. That is, if the value counted by the counter is not greater than the predetermined value, the controller assumes that a genuine toner cartridge without a memory device (e.g., a toner cartridge supplied together with the apparatus) is installed in the image-forming apparatus, and proceeds to exercise the second type of control conformable to the genuine toner cartridge. Accordingly, the image-forming apparatus configured as described above may be conformable to a genuine toner cartridge without a memory device such as a toner cartridge supplied together with the apparatus, as well as a genuine toner cartridge with a memory device and other toner cartridges.

Hereupon, the value concerning image formation counted each time when the image-forming apparatus performs the image formation may be a value increasing substantially in proportion to the quantity of operation for image formation, for example, the quantity of laser beam radiation for forming an electrostatic latent image on a photoconductor (i.e., the number of dots that has been printed), or the quantity of recording paper that has been consumed.

The image-forming apparatus according to another exemplary embodiment of the present invention comprises a cartridge detector, a toner detector, a reader and a controller. The cartridge detector is configured to determine the presence or absence of the toner cartridge. The toner detector is configured to determine whether or not the toner cartridge is empty of toner. The reader is configured to retrieve data from a memory device in the toner cartridge. The controller is configured to exercise one of two types of control over units of the image-forming apparatus. The type of control the controller is configured to exercise is either a first type of control conformable to a toner cartridge other than a genuine toner cartridge or a second type of control conformable to the genuine toner cartridge. The first type of control is exercised if the following conditions are satisfied: the cartridge detector determines that the toner cartridge is present; the toner detector has ever determined that the toner cartridge is empty of toner; and the reader has failed retrieval of predetermined data. Otherwise (if any of the above conditions is not satisfied), the second type of control conformable to the genuine toner cartridge is exercised.

With this configuration, the controller is configured to exercise the second type of control conformable to the genuine toner cartridge when the toner detector has never before determined that the toner cartridge is empty of toner even if the reader has failed retrieval of predetermined data for reasons, such as the absence of the toner cartridge or the absence of the memory device in the toner cartridge. That is, if the toner detector has never before determined that the toner cartridge is empty of toner, the controller assumes that a genuine toner cartridge without a memory device (e.g., a toner cartridge supplied together with the apparatus) is installed in the image-forming apparatus, and proceeds to exercise the second type of control conformable to the genuine toner cartridge. Accordingly, the image-forming apparatus configured as described above may be conformable to a genuine toner cartridge without a memory device such as a toner cartridge supplied together with the apparatus, as well as a genuine toner cartridge with a memory device and other toner cartridges.

BRIEF DESCRIPTION OF THE DRAWINGS

The above aspects, other advantages and further features of the present invention will become more apparent by describing in detail illustrative, non-limiting embodiments thereof with reference to the accompanying drawings, in which.

DETAILED DESCRIPTION OF THE EXEMPLARY EMBODIMENTS

First Embodiment

General Setup of Laser Printer

At the outset, a detailed description will be given of the exemplary embodiments of the present invention with reference made to the drawings where appropriate.

Figure 1:
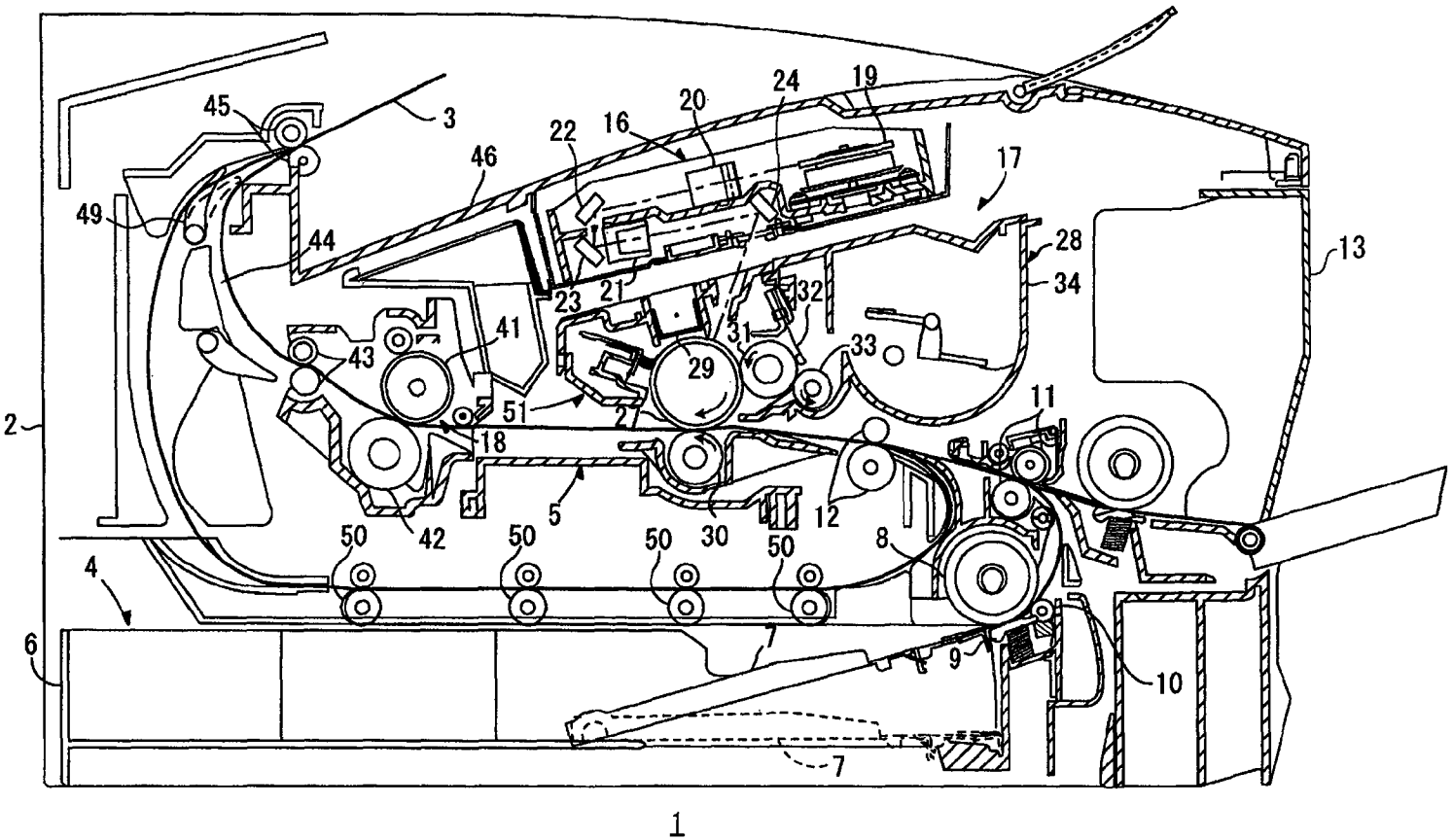
FIG. 1 is a vertical section of a laser printer according to an exemplary embodiment of the present invention.
Figure 2:
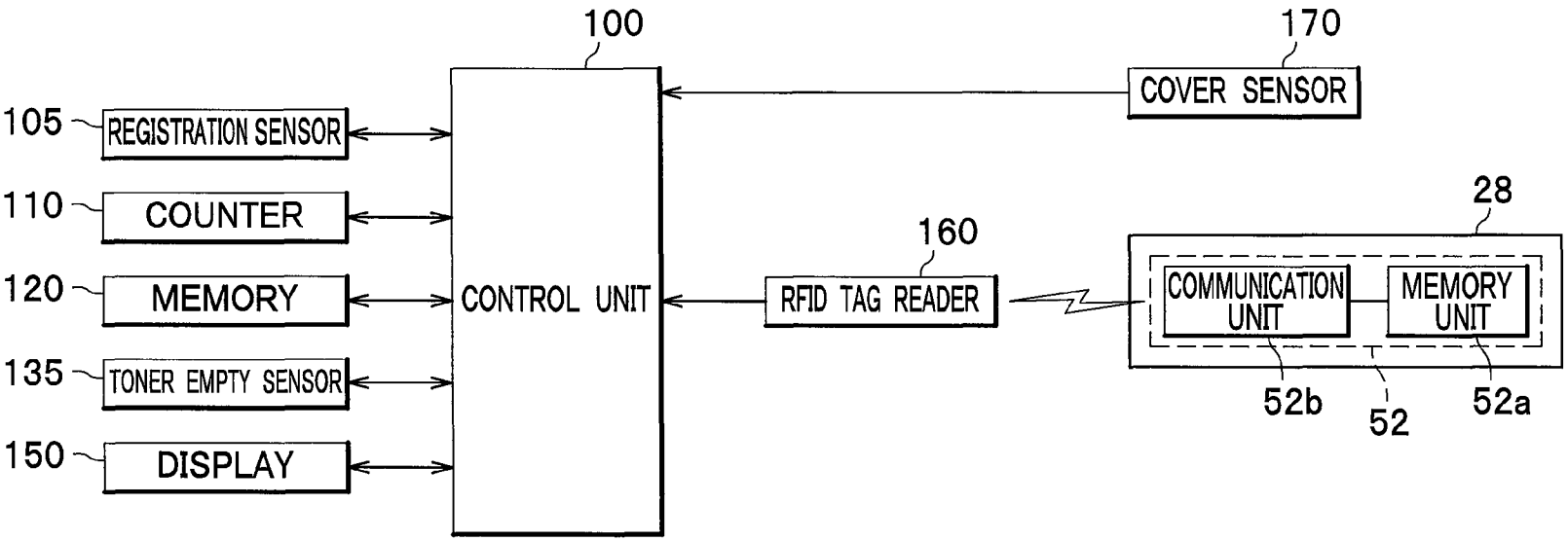
FIG. 2 is a block diagram of a control unit.

In the drawings to which reference will be made, shown in FIG. 1 is a general setup of a laser printer as an example of an image-forming apparatus according to an exemplary embodiment of the present invention, and shown in a block diagram of FIG. 2 is a control unit of the laser printer.

As shown in FIG. 1, the laser printer 1 includes a feeder unit 4 for feeding a sheet 3 into a body casing 2, an image-forming unit 5 for forming an image on a sheet 3 fed by the feeder unit 4, a control unit 100 (see FIG. 2) as a controller configured to exercise control over each unit of the laser printer, and a number of other components.

Feeder Unit Setup

The feeder unit 4 includes a sheet feed tray 6 and a sheet pressure plate 7. The sheet feed tray 6 is removably installed in a bottom space provided in the body casing 2. The sheet pressure plate 7 is provided in the sheet feed tray 6. The feeder unit 4 also includes a sheet feed roller 8, a sheet feed pad 9, and a paper powder remover rollers 10, 11. The sheet feed roller 8 and the sheet feed pad 9 are provided above an edge of one side of the sheet feed tray 6. The paper powder remover rollers 10, 11 are provided along a route of conveyance of the sheet 3 downstream relative to the sheet feed roller 8 in a direction of the conveyance of the sheet 3. The feeder unit 4 further includes a registration roller 12 located downstream relative to the paper powder remover rollers 10, 11.

The feeder unit 4 constructed as described above is configured to bring one sides of sheets 3 in the sheet feed tray 6 close to the sheet feed roller 8 by means of the sheet pressure plate 7, feed the sheets 3 one after another by means of the sheet feed roller 8 and the sheet feed pad 9 to pass each sheet 3 through rollers 10, 11 and 12 to the image-forming unit 5 on a one-by-one basis.

Image-forming Unit Setup

The image-forming unit 5 includes a scanner unit 16, a process cartridge 17, a fixing unit 18, and other components.

Scanner Unit Setup Outlined

The scanner unit 16 is disposed in an upper space provided in the body casing 2. The scanner unit 16 includes a light source device (not shown), a polygon mirror 19, an fθ lens 20, a correcting lens 21, and reflecting mirrors 22, 23, 24. The polygon mirror 19 is typically shaped like a regular hexagonal prism having mirrors formed at its six sides, and configured to reflect a laser beam emitted from the light source device while being driven to spin so that the laser beam is biased to scan in a main scanning direction. The fθ lens 20 is configured to convert the laser beam made by the polygon mirror 19 to scan with a constant angular speed into a laser beam which scans a surface of a photoconductor drum 27 at a constant speed and forms an image thereon.

Process Cartridge Setup

The process cartridge 17 is disposed below the scanner unit 16, and detachably installed in the body casing 2 through an opening over which is provided a front cover 13 swingably hinged at a sidewall of the body casing 2. A hollow housing 51 making up the outer frame of the process cartridge 17 accommodates a toner cartridge 28, a photoconductor drum 27, a scorotron charger 29, a transfer roller 30, and other components.

The toner cartridge 28 is detachably attached to the housing 51, and includes a development roller 31, a doctor blade 32, a supply roller 33 and a toner hopper 34. Toner in the toner hopper 34 is supplied to the development roller 31 by the action of the supply roller 33 rotating in a direction indicated by arrow (counterclockwise), and at the same time becomes positively charged by friction between the supply roller 33 and the development roller 31. The toner supplied onto the development roller 31 goes between the doctor blade 32 and the development roller 31 as the development roller 31 rotates in a direction indicated by arrow (counterclockwise), to form a thin film in a predetermined thickness, so that the film of toner is retained on the development roller 31.

The photoconductor drum 27 is supported by the housing 51 in such a manner that the photoconductor drum 27 is rotatable in a direction indicated by arrow (clockwise). The photoconductor drum 27 has its drum body grounded, while a positively charged photoconductive layer made of polycarbonate is formed at a cylindrical surface of the drum body.

The scorotron charger 29 is disposed over the photoconductor drum 27 and opposed to the photoconductive surface of the photoconductor drum 27 with a gap left between the photoconductor drum 27 and the scorotron charger 29 so as to keep the scorotron charger 29 from contact with the photoconductor drum 27. The scorotron charger 29 may be a known charger of scorotron type having a charging wire made of tungsten or the like for generating corona discharge and configured to positively charge the surface of the photoconductor drum 27 uniformly.

The transfer roller 30 is disposed under the photoconductor drum 27 and opposed to the photoconductive surface of the photoconductor drum 27, so as to have contact with the photoconductive surface of the photoconductor drum 27. The transfer roller 30 is supported by the housing 51 in such a manner that the transfer roller 30 is rotatable in a direction indicated by arrow (counterclockwise). The transfer roller 30 has a metal roller shaft covered with a conductive rubber material. In the transfer process, a transfer bias generated under constant-current control is applied to the transfer roller 30.

In operation, the photoconductive surface of the photoconductor drum 27 is positively charged uniformly by the scorotron charger 29, and then exposed to a rapidly scanning laser beam from the scanner unit 16. This exposure process lowers the potential of an exposed area(s) on the photoconductive surface, thus forming an electrostatic latent image based upon the image data. Hereupon, "electrostatic latent image" is an invisible image produced on the uniformly positively charged surface of the photoconductor drum 27 with the exposed areas made lower in potential by exposure to the laser beam. Next, as the development roller 31 rotates, toner particles carried on the development roller 31 come in contact with the opposed photoconductor drum 27; then the toner particles are supplied onto the surface of the photoconductor drum 27, and transferred to the areas corresponding to the electrostatic latent image formed thereon. The toner particles are retained selectively, i.e., solely in the areas corresponding to the electrostatic latent image, and thus visualize the latent image, to form a toner image. The process described above is called reversal process.

Thereafter, as the photoconductor drum 27 and the transfer roller 30 rotate so that the sheet 3 is held and fed forward between the rollers 27 and 30, the toner image formed on the surface of the photoconductor drum 27 is transferred to the sheet 3 while the sheet 3 is conveyed between the photoconductor drum 27 and the transfer roller 30.

Fixing Unit Setup

The fixing unit 18, which is disposed downstream relative to the process cartridge 17, includes a heating roller 41, a pressure roller 42 opposed to the heating roller 41 and configured to be pressed against the heating roller 41, and a pair of conveyor rollers 43 disposed downstream relative to the heating roller 41 and the pressure roller 42. In the fixing unit 18 constructed as described above, the toner image transferred onto the sheet 3 is fixed by heating and fusing the toner while the sheet 3 goes between the heating roller 41 and the pressure roller 42. Thereafter, the sheet 3 is conveyed by the conveyor rollers 43 to a sheet output path 44. The sheet 3 forwarded to the sheet output path 44 is then discharged by sheet output rollers 45 onto a sheet output tray 46, or returned by reverse rotation of the sheet output rollers 45 and switching of a flapper 49 into the apparatus, so that the sheet 3 is supplied again to a point upstream relative to the image-forming unit 5 by a plurality of reverse conveyor rollers 50, for double-sided printing.

Control Unit Setup

To the control unit 100 as shown in FIG. 2 are electrically and communicatively coupled a counter 110, a nonvolatile memory 120, a toner empty sensor 135, a display 150, a RFID tag reader 160, and other components. The counter 110 in this embodiment is configured to count the number of lighting dots which is indicative of the quantity of laser beam radiation. The toner empty sensor 135 is an example of a cartridge detector configured to determine the presence or absence of the toner cartridge 28, i.e., whether or not the toner cartridge 28 is installed in the laser printer 1, by detecting the presence or absence of toner. The display 150 is a display device comprised, for example, of liquid crystal material and other components. The RFID tag reader 160 is an example of a reader configured to retrieve data from an RFID tag (as an example of a memory device) 52 provided in the toner cartridge 28.

The RFID tag 52 includes a memory unit 52*a* configured to store data for the toner cartridge 28, and a communication unit 52*b* configured to communicate with the control unit 100. In the memory unit 52*a* is stored information on the toner cartridge 28 which includes identification information (hereinafter referred to as "ID"), date (year/month/day) of manufacture, serial number, and the like. The communication unit 52*b* is configured to respond to communication instructions transmitted through the RFID tag reader 160 from the control unit 100; upon receipt of the communication instructions, the communication unit 52*b* retrieves data from the memory unit 52*a* and transmits the retrieved data through the RFID tag reader 160 to the control unit 100. Thus, a toner cartridge 28 with an RFID tag 52 can be identified as a genuine product without fail by the fact that the data such as a corresponding ID can be retrieved from the RFID tag 52.

A registration sensor 105 is provided along a route of conveyance of a sheet 3 in a position upstream relative to the registration roller 12, and configured to be turned ON when a sheet 3 is brought into contact with an actuator thereof disposed on the route of conveyance of the sheet 3, and turned OFF when no sheet 3 is brought into contact with the actuator. The registration sensor 105 outputs a detection signal that is either a high-level signal or a low-level signal corresponding to the ON or OFF of the actuator, which is received by the control unit 100. The differentiated detection signal level (high or low) allows the control unit 100 to determine the presence or absence of the paper 3. From another viewpoint, the registration sensor is thus able to determine the quantity of paper 3 consumed.

The counter 110 is configured to count the number of light-emitting dots, indicative of the quantity of laser light radiation, which varies according to the image data. The cumulatively totalized value of the number of dots correlates with the quantity of toner consumed. The counter 110 is configured to keep the count value from being reset.

The toner empty sensor 135 is comprised of an optical sensor having a light-emitting element and a light-receiving element. The light-emitting element and the light-receiving element are disposed at outsides of windows (not shown) provided respectively in opposed sidewalls of the toner cartridge 28, so as to face each other through the windows. The toner empty sensor 135 uses the ratio of the quantity of light received by the light-receiving element to the quantity of light emitted from the light-emitting element, to determine the presence or absence of toner in the toner cartridge 28, and outputs a detection signal to the control unit 100. The toner empty sensor 135 is configured to detect the presence of toner in the toner cartridge 28, and thus may serve as a cartridge detector to determine whether the toner cartridge 28 is installed.

The RFID tag reader 160 is provided at a sidewall of the body casing 2, and arranged in such a position that it comes to a position opposed to the RFID tag 52 of the toner cartridge 28 when the toner cartridge 28 is installed. The RFID tag reader 160 electromagnetically reads data concerning the toner cartridge 28 in a noncontact manner from the memory unit 52*a* of the RFID tag 52.

The cover sensor 170 is provided in the body casing 2 and arranged near the front cover 13 so that the front cover 13 comes in contact with an actuator (not shown) of the cover sensor 170 when the front cover 13 is closed properly and completely. The cover sensor 170 has its actuator located on a path along which the front cover 13 is closed, and thus turns ON in the wake of contact of the front cover 13 with the actuator followed by the closing operation of the front cover 13. On the other hand, the cover sensor 170 remains OFF until the front cover 13 reaches an appropriate closed position and touches the actuator. The cover sensor 170 outputs a detection signal that is either high-level signal or a low-level signal corresponding to the ON or OFF of the actuator, which is received by the control unit 100. Thus differentiated detection signal level (high or low) allows the control unit 100 to determine the state of the front cover 13, i.e., whether the front cover 13 is open or closed.

The memory 120 is comprised, for example, of a nonvolatile random-access memory or NVRAM, and configured to hold a predetermined value for use as a reference in determining whether a toner cartridge currently in use is a supplied toner cartridge or not. The predetermined value, in this embodiment, is the number of dots printable derived from the quantity of toner in the supplied toner cartridge. That is, the count value counted by the counter 110 not greater than the predetermined value spells that there is toner remaining in the supplied toner cartridge and thus the supplied toner cartridge is installed.

The control unit 100 is comprised of a central processing unit or CPU, a random-access memory or RAM, a read-only memory or ROM, and other components, and configured to exercise control over units of the laser printer 1 to perform printing operation. The control unit 100 is also configured to cause the units to perform coordinated operations upon startup of printing according to the types of toner cartridge 28 installed. In order to exercise the control as mentioned above, the control unit 100 receives data on the toner cartridge 28 from the RFID tag 52 via the RFID tag reader 160. The toner cartridge 28 may, for example, be of three types consisting of: (1) genuine toner cartridge with RFID tag 52; (2) genuine toner cartridge without RFID tag 52 which is supplied together with the laser printer 1 purchased; and (3) the other toner cartridge.

Method of Control Implemented by Control Unit

Figure 3:
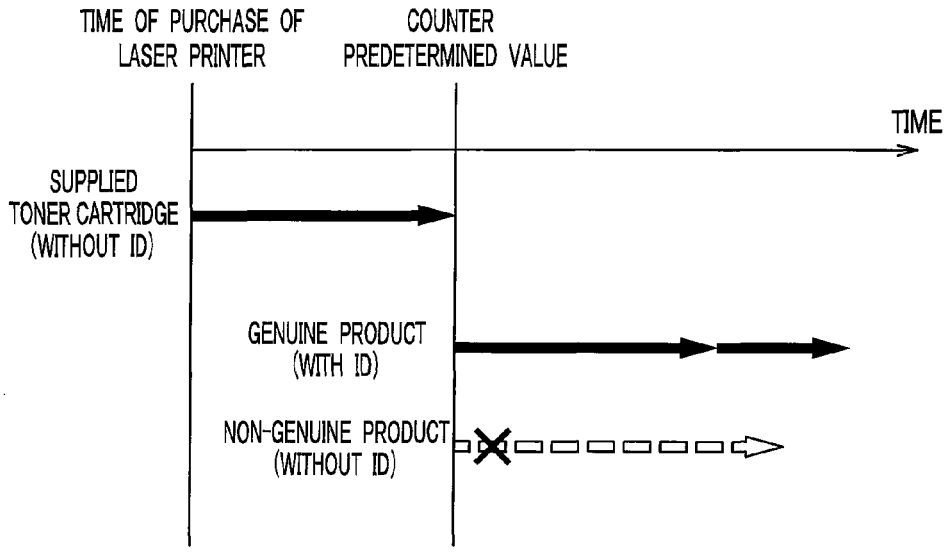
FIG. 3 is a time chart for explaining a process of control exercised by the control unit according to a first embodiment, as illustrated with the time axis represented by the horizontal axis.

Next, a method of control implemented by the control unit according to the present embodiment will be described with reference to FIG. 3, in which a time chart for explaining a process of control exercised by the control unit according to the first embodiment is illustrated with a graph having the time axis represented by the horizontal axis.

At the outset, in the present embodiment, the quantity of toner in the supplied toner cartridge is converted into the number of dots printable with that quantity of toner, and the number of dots is set as a predetermined (reference) value in the counter 110. It is assumed as shown in FIG. 3 that the toner cartridge installed in the body casing 2 is a supplied toner cartridge if the count value (cumulatively increased from the time of purchase 1 of the laser printer 1) is not greater than the predetermined value. Accordingly, if the count value is not greater than the predetermined value, the control unit 100 exercises a particular type of control conformable to the genuine product. On the other hand, it is assumed that the toner cartridge to be installed (replaced) in the body casing 2 is either of the genuine product or the non-genuine product if the count value is greater than the predetermined value. Accordingly, if the count value is greater than the predetermined value, the control unit 100 selectively exercises one of two types of control; i.e., the particular type of control conformable to the genuine product is exercised when it is determined that a genuine toner cartridge is installed, while an alternative type of control conformable to the non-genuine product is exercised when it is determined that a non-genuine toner cartridge is installed. In order to exercise the control as mentioned above, the control unit 100 may be configured to perform a process, for example, as discussed below.

Process of Control Upon Startup of Printing

Figure 4:
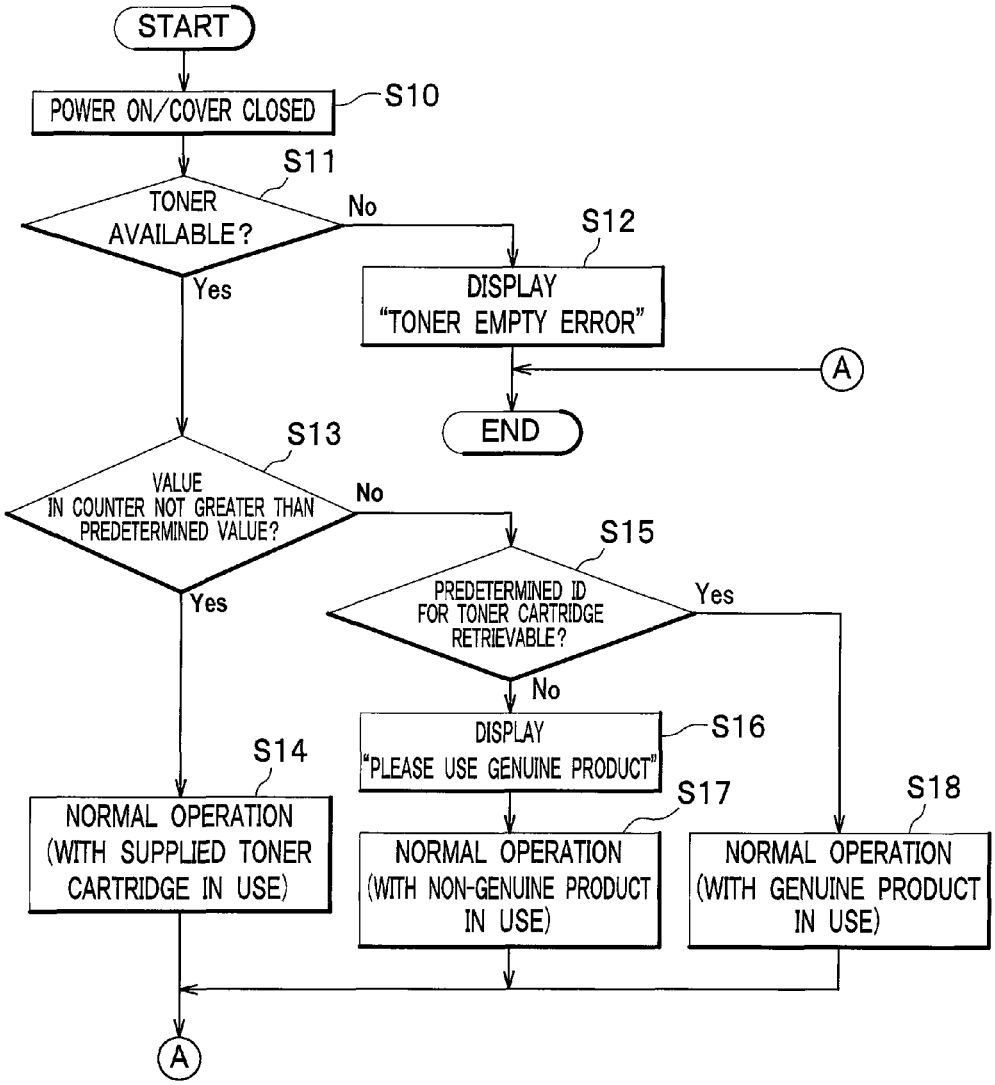
FIG. 4 is a flowchart showing a process of control at a time when printing is started, according to the first embodiment.

Process of control upon startup of printing of the laser printer 1 will be described with reference to a flowchart of FIG. 4, in which is shown a process of control at a time when printing is started, according to the first embodiment. The illustrated process flow may be implemented by the CPU of the control unit 100 executing programs stored in the RAM or ROM.

When the laser printer 1 is powered on, and the closed state of the front cover 13 is confirmed by a detection signal received from the cover sensor 170 (step S10), determination as to whether or not toner is available is made based upon a detection signal received from the toner empty sensor 135 (step S11).

If it is determined that toner is not available (No in step S11), then the control unit 100 transmits a display instruction to the display 150, and the display 150 in turn displays a "toner empty error" message (step S12). In this way, a user is prompted to install or replace a toner cartridge 28, and the process of the control unit 100 comes to an end.

On the other hand, if it is determined that toner is available (Yes in step S11), then the control unit 100 determines that a toner cartridge 28 is installed, and proceeds to subsequent determination as to whether the value counted in the counter 110 is not greater than the predetermined value (step S13).

If it is determined that the count value of the counter 110 is not greater than the predetermined value (Yes in step S13), then it is assumed that toner in the toner cartridge initially installed in the laser printer 1 still remains therein and thus the currently installed toner cartridge 28 is the supplied toner cartridge. Therefore, the control unit 100 exercises control of the type conformable to the genuine product, thus proceeding to cause the units of the laser printer 1 to perform normal printing operation (step S14), and the process of the control unit 100 comes to an end.

On the other hand, if it is determined that the count value of the counter 110 is greater than the predetermined value (No in step S13), then the control unit 100 attempts to retrieve data on the toner cartridge 28 from the RFID tag 52 through the RFID tag reader 160, and determines whether or not a predetermined ID is retrievable (step S15).

If the predetermined ID of the toner cartridge 28 is not retrievable (No in step S15), then the installed toner cartridge 28 turns out to be a non-genuine product. The control unit 100 then exercises control of the type conformable to the other toner cartridge, thus proceeding to transmit a display instruction to the display 150, and the display 150 in turn displays a "Please use a genuine product" message (step S16). In this way, a user is invited to use a genuine product; thereafter, the control unit 100 proceeds to cause the units of the laser printer 1 to perform normal printing operation (step S17), and the process of the control unit 100 comes to an end.

On the other hand, if the predetermined ID of the toner cartridge 28 is retrieved (Yes in step S15), then the installed toner cartridge 28 turns out to be a genuine product. The control unit 100 then exercises control of the type conformable to the genuine product, thus proceeding to cause the units of the laser printer 1 to perform the normal printing operation (step S18), and the process of the control unit 100 comes to an end. After the process comes to an end, in the present embodiment, the above-described process steps are performed every time when power is switched on or when the front cover 13 is closed.

By using the laser printer 1 configured as described above according to the present embodiment, the following advantageous effects can be exerted.

The control unit 100 is configured to exercise control of the type conformable to the non-genuine product only when the toner cartridge 28 turns out to be installed, the count value of the counter 110 is greater than a predetermined value, and a predetermined ID is not retrievable by the RFID tag reader 160 from the toner cartridge 28. That is, if the count value of the counter 110 is not greater than the predetermined value, control of the type conformable to the genuine product is exercised regardless of whether or not the predetermined ID is retrievable from the toner cartridge 28. Therefore, the RFID tag 52 which used to be necessitated in every toner cartridge does not have to be incorporated in the supplied toner cartridge which is packaged with the main body of the apparatus. Consequently, the production cost can be reduced and the productivity can be improved.

Second Embodiment

Figure 5:
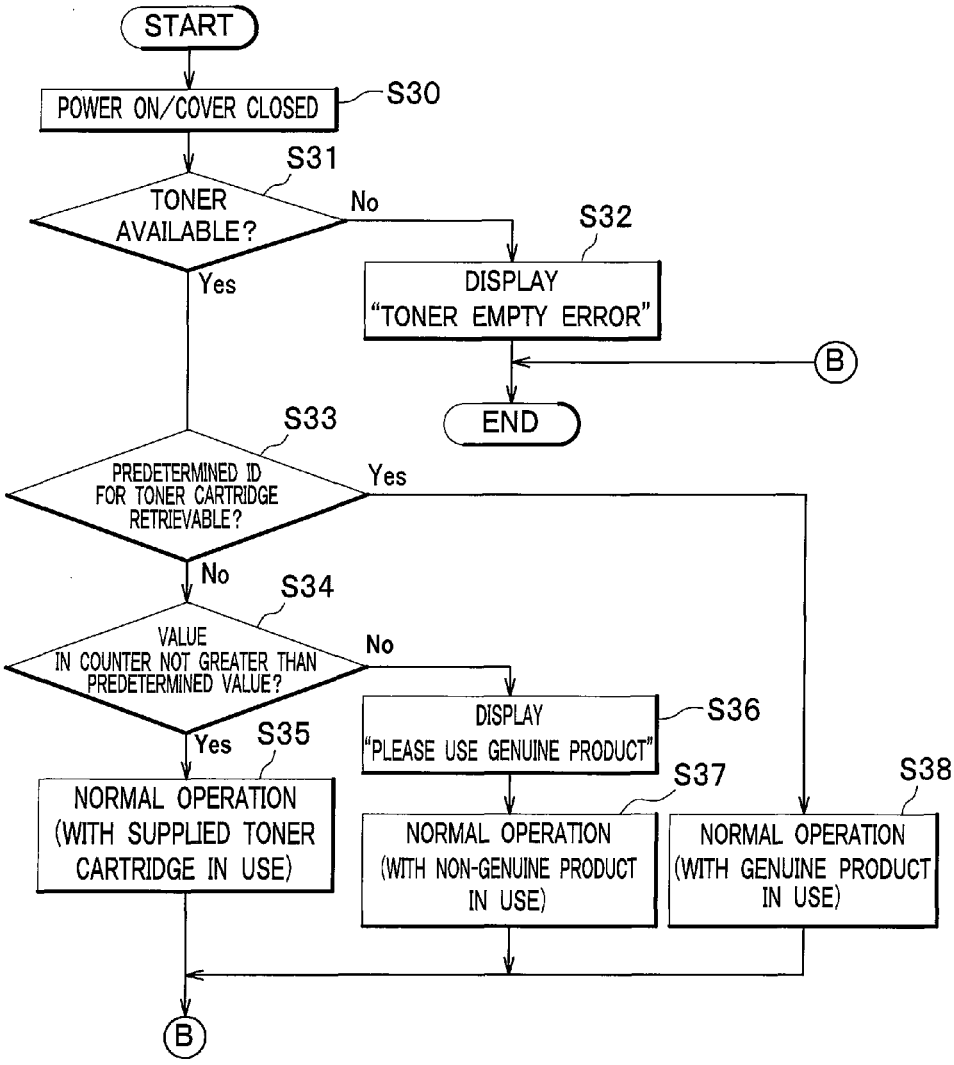
FIG. 5 is a flowchart showing a process of control at a time when printing is started, according to a second embodiment.

Next, a second embodiment of the present invention will be described. The general setup of a laser printer of the present embodiment may be implemented in a manner similar to that of the first embodiment as illustrated in FIGS. 1 and 2. The method of control in this embodiment may also be implemented by the control unit in a manner similar to that of the first embodiment as illustrated in FIG. 3. In the present embodiment, the process of control upon startup of printing as in the first embodiment is implemented with some steps thereof modified. Hereafter, the process of control upon startup of printing in the laser printer 1 according to the second embodiment of the present invention will be described with reference to a flowchart shown in FIG. 5.

Process of Control Upon Startup of Printing

When the laser printer 1 is powered on, and the closed state of the front cover 13 is confirmed by a detection signal received from the cover sensor 170 (step S30), determination as to whether or not toner is available is made based upon a detection signal received from the toner empty sensor 135 (step S31).

If it is determined that toner is not available (No in step S31), then the control unit 100 transmits a display instruction to the display 150, and the display 150 in turn displays a "toner empty error" message (step S32). In this way, a user is prompted to install or replace a toner cartridge 28, and the process of the control unit 100 comes to an end.

On the other hand, if it is determined that toner is available (Yes in step S31), then the control unit 100 determines that a toner cartridge 28 is installed. Then, the control unit 100 attempts to retrieve data on the toner cartridge 28 from the RFID tag 52 through the RFID tag reader 160, and determines whether or not a predetermined ID is retrievable (step S33).

If the predetermined ID of the toner cartridge 28 is retrieved (Yes in step S33), then the installed toner cartridge 28 turns out to be a genuine product. The control unit 100 then exercises control of the type conformable to the genuine product, thus proceeding to cause the units of the laser printer 1 to perform the normal printing operation (step S38), and the process of the control unit 100 comes to an end.

On the other hand, if the predetermined ID of the toner cartridge 28 is not retrievable (No in step S33), then the installed toner cartridge 28 turns out to be a non-genuine product. Then, determination is made as to whether the count value of the counter 110 is not greater than the predetermined value (step S34).

If it is determined that the count value of the counter 110 is not greater than the predetermined value (Yes in step S34), then it is assumed that toner in the toner cartridge initially installed in the laser printer 1 still remains therein and thus the currently installed toner cartridge 28 is the supplied toner cartridge. Therefore, the control unit 100 exercises control of the type conformable to the genuine product, thus proceeding to cause the units of the laser printer 1 to perform the normal printing operation (step S35), and the process of the control unit 100 comes to an end.

On the other hand, if it is determined that the count value of the counter 110 is greater than the predetermined value (No in step S34), then it is assumed that the currently installed toner cartridge 28 is a non-genuine product. The control unit 100 then exercises control of the type conformable to the other toner cartridge, thus proceeding to transmit a display instruction to the display 150, and the display 150 in turn displays a "Please use a genuine product" message (step S36). In this way, a user is invited to use a genuine product; thereafter, the control unit 100 proceeds to cause the units of the laser printer 1 to perform the normal printing operation (step S37), and the process of the control unit 100 comes to an end. After the process comes to an end, in the present embodiment, the above-described process steps are performed every time when power is switched on or when the front cover 13 is closed.

By using the laser printer 1 configured as described above according to the present embodiment, the following advantageous effects can be exerted.

The control unit 100 is configured to exercise control of the type conformable to the non-genuine product only when the toner cartridge 28 turns out to be installed, a predetermined ID is not retrievable by the RFID tag reader 160 from the toner cartridge 28, and the count value of the counter 110 is greater than a predetermined value. That is, even when the predetermined ID is not retrievable from the toner cartridge 28, if the count value of the counter 110 is not greater than the predetermined value, control of the type conformable to the genuine product is exercised. Therefore, the RFID tag 52 which used to be necessitated in every toner cartridge does not have to be incorporated in the supplied toner cartridge which is packaged with the main body of the apparatus. Consequently, the production cost can be reduced and the productivity can be improved.

Third Embodiment

Next, a third embodiment of the present invention will be described. In the present embodiment, the control unit setup, the method of control by the control unit, and process of control upon startup of printing in the first embodiment are modified.

Control Unit Setup

Figure 6:
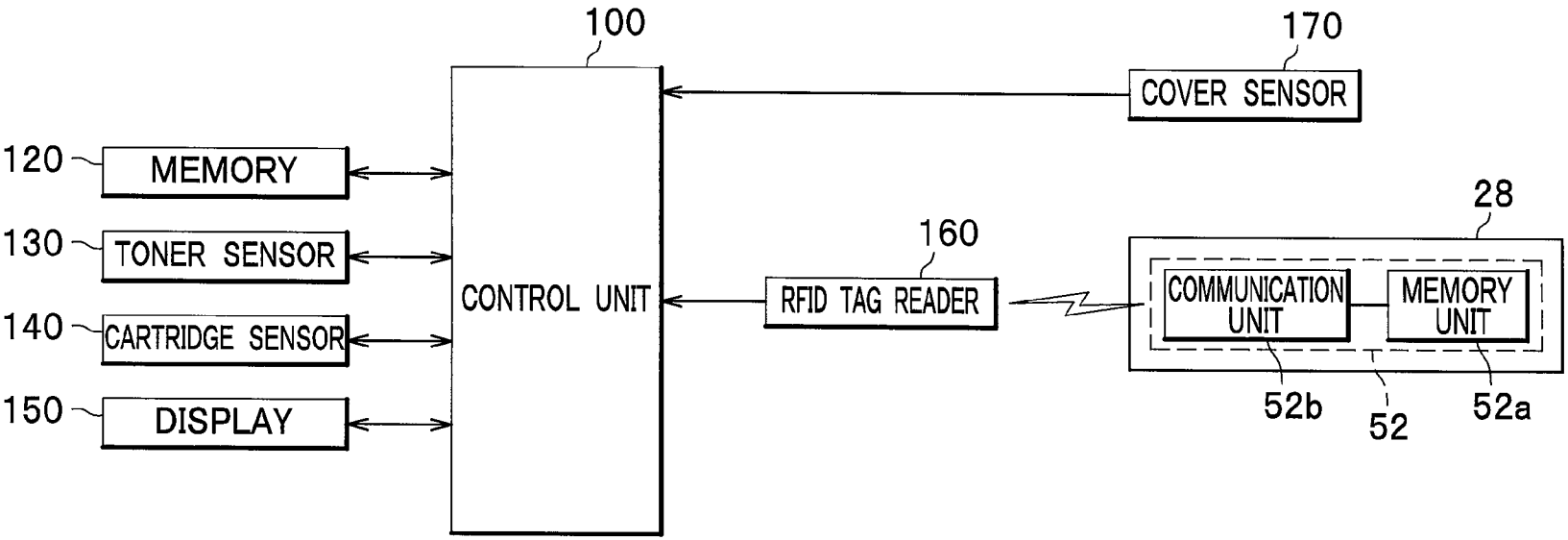
FIG. 6 is a block diagram of a control unit according to a third embodiment.

To the control unit 100 as shown in FIG. 6, are electrically and communicatively coupled a nonvolatile memory 120, a toner sensor 130, a cartridge sensor 140, an RFID tag reader 160 and other components. The toner sensor 130 is an example of a toner detector configured to determine the presence or absence of toner in the toner cartridge 28. The cartridge sensor 140 is an example of a cartridge detector configured to determine the presence or absence of the toner cartridge 28, i.e. whether or not the toner cartridge 28 is installed in the laser printer 1. The display 150 is a display device comprised, for example, of liquid crystal material and other components. The RFID tag reader 160 is an example of a reader configured to retrieve data from an RFID tag (as an example of a memory device) 52 provided in the toner cartridge 28.

The memory 120 is configured to have a storage space for recording toner empty error history data when the toner sensor 130 detects toner empty as will be described later.

The toner sensor 130 has the same configuration as the toner empty sensor 135 of the first embodiment.

In the present embodiment, the cartridge sensor 140 is provided in addition to the toner sensor 130. The cartridge sensor 140 is provided in the body casing 2 and arranged near a location where the toner cartridge 28 is installed so that the toner cartridge 28 comes in contact with an actuator (not shown) of the cartridge sensor 140 when the toner cartridge 28 is installed in the body casing 2 of the laser printer 1. The cartridge sensor 140 has its actuator located on a path along which the toner cartridge 28 is installed, and thus turns ON in the wake of contact of the toner cartridge 28 with the actuator followed by the operation of installing the toner cartridge 28. On the other hand, the cartridge sensor 140 remains OFF until the toner cartridge 28 is properly installed and touches the actuator. The cartridge sensor 140 outputs a detection signal that is either high-level signal or low-level signal corresponding to the ON or OFF of the actuator, which is received by the control unit 100. Thus differentiated detection signal level (high or low) allows the control unit 100 to determine the state of the toner cartridge 28, i.e., whether the toner cartridge 28 is installed or not.

Method of Control Implemented by Control Unit

Figure 7:
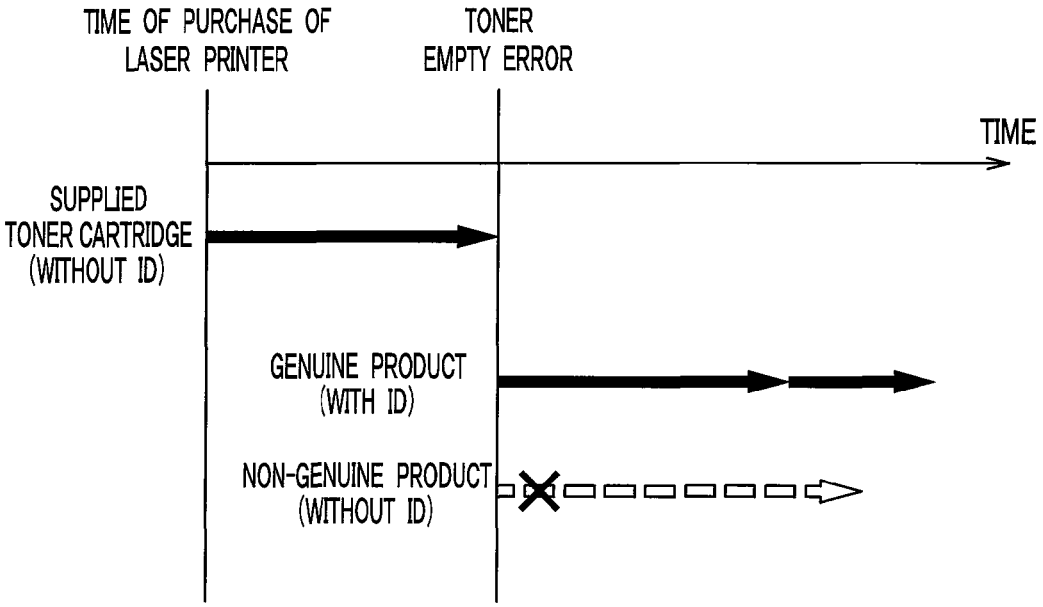
FIG. 7 is a time chart for explaining a process of control exercised by the control unit according to the third embodiment, as illustrated with the time axis represented by the horizontal axis.

A method of control implemented by the control unit according to the present embodiment will be described with reference to FIG. 7, in which a time chart for explaining a process of control exercised by the control unit according to the third embodiment is illustrated with a graph having the time axis represented by the horizontal axis.

In the present embodiment, ever since the toner sensor 130 detects a toner empty error for the first time, data on each and every occurrence of the toner empty error is recorded in the memory 120. As shown in FIG. 7, it is assumed that before the toner empty error occurs for the first time (from the time of purchase of the laser printer 1), the toner cartridge installed in the body casing 2 is a supplied toner cartridge. Thus, the control unit 100 is configured to exercise a specific type of control conformable to the genuine product before the toner empty error occurs for the first time. On the other hand, it is assumed that after the first occurrence of the toner empty error, the toner cartridge to be installed (replaced) in the body casing 2 is either of the genuine product or the non-genuine product. Thus, the control unit 100 is then configured to exercise a conformable type of control, i.e.; the particular type of control conformable to the genuine product is exercised when it is determined that a genuine toner cartridge is installed, while an alternative type of control conformable to the non-genuine product is exercised when it is determined that a non-genuine product is installed. In order to exercise the control as mentioned above, the control unit 100 may be configured to perform a process, for example, as discussed below.

Process of Control Upon Startup of Printing

Figure 8:
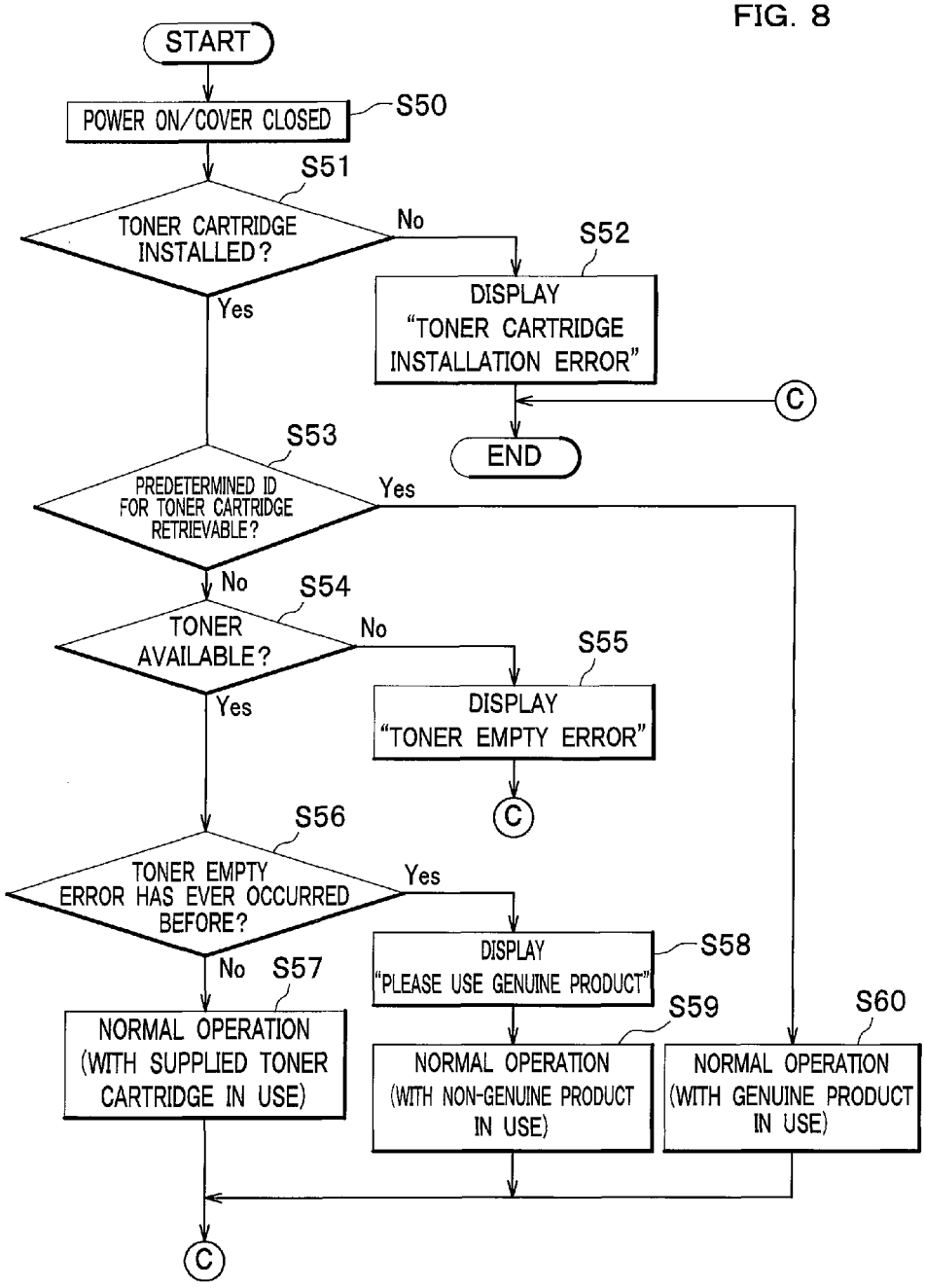
FIG. 8 is a flowchart showing a process of control at a time when printing is started, according to the third embodiment.

Process of control upon startup of printing of the laser printer 1 will be described with reference to a flowchart of FIG. 8, in which is shown a process of control at a time when printing is started, according to the third embodiment.

When the laser printer 1 is powered on, and the closed state of the front cover 13 is confirmed by a detection signal received from the cover sensor 170 (step S50), determination as to whether or not a toner cartridge 28 is installed properly is made based upon a detection signal received from the cartridge sensor 140 (step S51).

If it is determined that no toner cartridge 28 is installed properly (No in step S51), then the control unit 100 transmits a display instruction to the display 150, and the display in turn displays a "toner cartridge installation error" message (step S52). In this way, a user is prompted to properly install (or correct improper installation of) the toner cartridge 28, and the process of the control unit 100 comes to an end.

On the other hand, if it is determined that the toner cartridge 28 is installed properly (Yes in step S51), then the control unit 100 attempts to retrieve data on the toner cartridge 28 from the RFID tag 52 through the RFID tag reader 160, and determines whether or not a predetermined ID is retrievable (step S53).

If the predetermined ID of the toner cartridge 28 is retrieved (Yes in step S53), then the installed toner cartridge 28 turns out to be a genuine product. The control unit 100 then exercises control of the type conformable to the genuine product, thus proceeding to cause the units of the laser printer 1 to perform the normal printing operation (step S60), and the process of the control unit 100 comes to an end.

On the other hand, if the predetermined ID of the toner cartridge 28 is not retrievable (No in step S53), then the installed toner cartridge 28 turns out to be either a supplied cartridge or a non-genuine product. Then, determination as to whether or not toner remains available in the toner cartridge 28 is made based upon a detection signal received from the toner sensor 130 (step S54).

If it is determined that no toner remains available in the toner cartridge 28 (No in step S54), then the control unit 100 transmits a display instruction to the display 150, which in turn displays a "toner empty error" message, and transmits the data on the occurrence of the toner empty error to the memory 120 so that the data is recorded in the memory 120 (step S55). In this way, a user is prompted to install or replace a toner cartridge 28, and the process of the control unit 100 comes to an end.

On the other hand, if it is determined that toner remains available in the toner cartridge 28 (Yes in step S54), then the control unit 100 retrieves data from the memory 120 to determine whether or not a toner empty error has ever occurred (step S56).

If the control unit 100 determines that no toner empty error has occurred ever since (No in step S56), then it is assumed that the toner cartridge 28 first installed in the laser printer 1 has not been replaced ever before and thus the currently installed toner cartridge 28 is the supplied toner cartridge. Therefore, the control unit 100 exercises control of the type conformable to the genuine product, thus proceeding to cause the units of the laser printer 1 to perform the normal printing operation (step S57), and the process of the control unit 100 comes to an end.

On the other hand, if the control unit 100 determines that one or more toner empty errors have occurred before (Yes in step S56), then it is determined that the toner cartridge 28 first installed in the laser printer 1 has been replaced with another toner cartridge and thus the currently installed toner cartridge 28 is not the supplied toner cartridge but instead a non-genuine product. Accordingly, the control unit 100 exercises control of the type conformable to the other toner cartridge, thus proceeding to transmit a display instruction to the display 150, and the display 150 in turn displays a "Please use a genuine product" message (step S58). In this way, a user is invited to use a genuine product; thereafter, the control unit 100 proceeds to cause the units of the laser printer 1 to perform normal printing operation (step S59), and the process of the control unit 100 comes to an end. After the process comes to an end, in the present embodiment, the above-described process steps are performed every time when power is switched on or when the front cover 13 is closed.

By using the laser printer 1 configured as described above according to the present embodiment, the following advantageous effects can be exerted.

The control unit 100 is configured to exercise control of the type conformable to the non-genuine product only when the toner cartridge 28 turns out to be installed, a predetermined ID is not retrievable by the RFID tag reader 160 from the toner cartridge 28, and one or more toner empty errors have occurred before. That is, even when the predetermined ID is not retrievable from the toner cartridge 28, if no toner empty error has ever occurred before, control of the type conformable to the genuine product is exercised. Therefore, the RFID tag 52 which used to be necessitated in every toner cartridge does not have to be incorporated in the supplied toner cartridge which is packaged with the main body of the apparatus. Consequently, the production cost can be reduced and the productivity can be improved.

Fourth Embodiment

Figure 9:
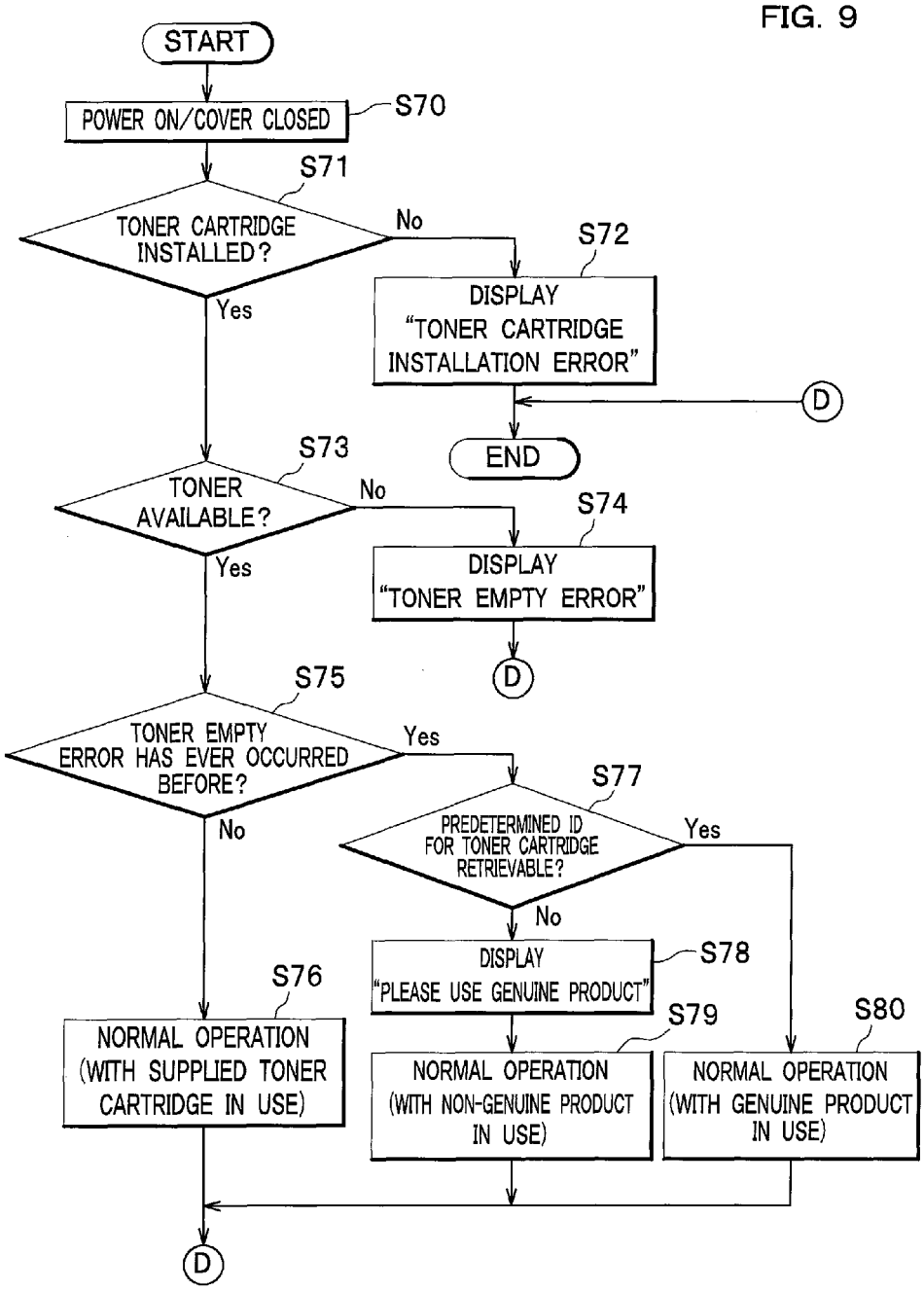
FIG. 9 is a flowchart showing a process of control at a time when printing is started, according to a fourth embodiment.

Next, a fourth embodiment of the present invention will be described. The general setup of a laser printer of the present embodiment may be implemented in a manner similar to that of the first embodiment as illustrated in FIGS. 1 and 2. The method of control in this embodiment may be implemented by the control unit in a manner similar to that of the third embodiment as illustrated in FIG. 7. In the present embodiment, the process of control upon startup of printing as in the third embodiment is implemented with some steps thereof modified. Hereafter, the process of control upon startup of printing in the laser printer 1 according to the fourth embodiment of the present invention will be described with reference to a flowchart shown in FIG. 9.

Process of Control Upon Startup of Printing

When the laser printer 1 is powered on, and the closed state of the front cover 13 is confirmed by a detection signal received from the cover sensor 170 (step S70), determination as to whether or not a toner cartridge 28 is installed properly is made based upon a detection signal received from the cartridge sensor 140 (step S71).

If it is determined that no toner cartridge 28 is installed properly (No in step S71), then the control unit 100 transmits a display instruction to the display 150, and the display in turn displays a "toner cartridge installation error" message (step S72). In this way, a user is prompted to properly install (or correct improper installation of) the toner cartridge 28, and the process of the control unit 100 comes to an end.

On the other hand, if it is determined that the toner cartridge 28 is installed properly (Yes in step S71), then determination as to whether or not toner remains available in the toner cartridge 28 is made based upon a detection signal received from the toner sensor 130 (step S73).

If it is determined that no toner remains available in the toner cartridge 28 (No in step S73), then the control unit 100 transmits a display instruction to the display 150, which in turn displays a "toner empty error" message, and transmits the data on the occurrence of the toner empty error to the memory 120 so that the data is recorded in the memory 120 (step S74). In this way, a user is prompted to install or replace a toner cartridge 28, and the process of the control unit 100 comes to an end.

On the other hand, if it is determined that toner remains available in the toner cartridge 28 (Yes in step 73), then the control unit 100 retrieves data from the memory 120 to determine whether or not a toner empty error has ever occurred (step S75).

If the control unit 100 determines that no toner empty error has occurred ever since (No in step S75), then it is assumed that the toner cartridge first installed in the laser printer 1 is still installed therein without being replaced and thus the currently installed toner cartridge 28 is the supplied toner cartridge. Therefore, the control unit 100 exercises control of the type conformable to the genuine product, thus proceeding to cause the units of the laser printer 1 to perform the normal printing operation (step S76), and the process of the control unit 100 comes to an end.

On the other hand, if the control unit 100 determines that one or more toner empty errors have occurred before (Yes in step S75), then it is assumed that the toner cartridge 28 first installed in the laser printer 1 has been replaced with another toner cartridge and thus the currently installed toner cartridge 28 is either of the genuine product or the non-genuine product. Therefore, the control unit 100 retrieves data on the toner cartridge 28 from the RFID tag 52 through the RFID tag reader 160, and determines whether or not a predetermined ID is retrievable therefrom (step S77).

If the predetermined ID of the toner cartridge 28 is not retrievable (No in step S77), then the installed toner cartridge 28 turns out to be a non-genuine product. Accordingly, the control unit 100 exercises control of the type conformable to the other toner cartridge, thus proceeding to transmit a display instruction to the display 150, and the display 150 in turn displays a "Please use a genuine product" message (step S78). In this way, a user is invited to use a genuine product; thereafter, the control unit 100 proceeds to cause the units of the laser printer 1 to perform normal printing operation (step S79), and the process of the control unit 100 comes to an end.

On the other hand, if the predetermined ID of the toner cartridge 28 is retrieved (Yes in step S77), then the installed toner cartridge 28 turns out to be a genuine product. The control unit 100 then exercises control of the type conformable to the genuine product, thus proceeding to cause the units of the laser printer 1 to perform the normal printing operation (step S80), and the process of the control unit 100 comes to an end. After the process comes to an end, in the present embodiment, the above-described process steps are performed every time when power is switched on or when the front cover 13 is closed.

By using the laser printer 1 configured as described above according to the present embodiment, the following advantageous effects can be exerted.

The control unit 100 is configured to exercise control of the type conformable to the non-genuine product only when the toner cartridge 28 turns out to be installed, one or more toner empty errors have occurred before, and a predetermined ID is not retrievable by the RFID tag reader 160 from the toner cartridge 28. That is, if no toner empty error has occurred before, control of the type conformable to the genuine product is exercised irrespective of whether or not the predetermined ID is retrievable from the toner cartridge 28. Therefore, the RFID tag 52 which used to be necessitated in every toner cartridge does not have to be incorporated in the supplied toner cartridge which is packaged with the main body of the apparatus. Consequently, the production cost can be reduced and the productivity can be improved.

Exemplary Embodiments Modified

Some exemplary embodiments of the present invention have been described above. The present invention is not limited to these embodiments, and may be carried out into practice in various other ways. Thus, it is contemplated that various modifications and changes may be made to the exemplary embodiments of the invention without departing from the spirit and scope of the embodiments of the present invention as defined in the appended claims.

In the embodiments described above, the memory device provided in the toner cartridge 28 and the reader for retrieving data therefrom are exemplified by the RFID tag 52 and the RFID tag reader 160 with which data from the RFID tag 52 is retrievable in a noncontact manner. The present invention is however not limited to these illustrative embodiments, but any other combinations available of memory devices and readers may be applied. For example, a proximity communication IC chip and a reader configured to retrieved data therefrom may be adopted in combination.

Although the above embodiments have described a counter configured to count the number of dots which varies in accordance with the image data as an example of a counter configured to count a value concerning image formation, the present invention is not limited thereto. For example, a counter configured to count the number of rotations of the photoconductor drum 27, a counter configured to count the number of rotations of the development roller 31, a counter configured to count the number of sheets to be printed which is detected by the registration sensor 105, or any other counter available may be applied.

In the embodiments described above, the control of the type conformable to the other toner cartridge is exemplified by the control under which a specific message is displayed, but the present invention is not limited to these embodiments. For example, the control of the type conformable to the other toner cartridge may include a control under which a printing speed is reduced so as to prevent printing quality from becoming degraded, or a control under which the frequency of cleaning of the photoconductor drum 27 is increased. In these cases, a special printing operation for non-genuine product is carried out instead of the normal printing operation.

In the exemplary embodiments described above, the present invention is applied to a laser printer 1; however, the present invention is not limited thereto, but may be applied, for example, to a copier, an all-in-one printer, and other image-forming apparatuses.

What is claimed is:

1. An image-forming apparatus comprising:

a main body;

a first toner cartridge that is a genuine toner cartridge without a memory device, wherein the first toner cartridge is a toner cartridge supplied with the main body;

a cartridge installation part configured to receive at least two different types of toner cartridges, wherein the at least two different types of toner cartridges include the first toner cartridge, and a second toner cartridge that is a genuine toner cartridge with a memory device and is to be supplied as a replacement for the first toner cartridge;

a reader configured to retrieve data from the memory device in the second toner cartridge received in the cartridge installation part; and a memory configured to store data for use in determining whether or not a toner cartridge received in the cartridge installation part is the first toner cartridge supplied with the main body.

2. The image-forming apparatus according to claim 1, wherein the at least two different types of toner cartridges include a third toner cartridge that is a non-genuine toner cartridge.

3. The image-forming apparatus according to claim 2, further comprising a controller configured to exercise control based on which of the at least two different types of toner cartridges is received in the cartridge installation part.

4. The image-forming apparatus according to claim 3, wherein the exercise of control by the controller includes providing a message.

5. The image-forming apparatus according to claim 4, wherein the exercise of control by the controller includes causing a normal image forming operation to be performed.

6. The image-forming apparatus according to claim 1, further comprising a controller configured to exercise control conformable to a genuine toner cartridge if it is determined, based on the data stored in the memory, that the toner cartridge in the cartridge installation part is the first toner cartridge supplied with the main body.

* * * * *